US010086398B2

(12) United States Patent
Akaishi et al.

(10) Patent No.: US 10,086,398 B2
(45) Date of Patent: Oct. 2, 2018

(54) APPLICATION DEVICE

(71) Applicant: SHINMAYWA INDUSTRIES, LTD., Hyogo (JP)

(72) Inventors: Daisuke Akaishi, Hyogo (JP); Shuichi Adachi, Hyogo (JP); Hitoshi Kamei, Hyogo (JP); Naoya Kishimoto, Hyogo (JP)

(73) Assignee: SHINMAYAWA INDUSTRIES, LTD., Hyogo (JP)

( * ) Notice: Subject to any disclaimer, the term of this patent is extended or adjusted under 35 U.S.C. 154(b) by 0 days.

(21) Appl. No.: 15/128,506

(22) PCT Filed: Feb. 17, 2015

(86) PCT No.: PCT/JP2015/000727
§ 371 (c)(1),
(2) Date: Sep. 23, 2016

(87) PCT Pub. No.: WO2015/145951
PCT Pub. Date: Oct. 1, 2015

(65) Prior Publication Data

US 2017/0106397 A1 Apr. 20, 2017

(30) Foreign Application Priority Data

Mar. 27, 2014 (JP) ..... 2014-066400

(51) Int. Cl.
*B05C 5/02* (2006.01)
*B05B 13/04* (2006.01)
(Continued)

(52) U.S. Cl.
CPC ..... *B05C 5/0216* (2013.01); *A46B 13/02* (2013.01); *B05B 12/084* (2013.01);
(Continued)

(58) Field of Classification Search
CPC . B05B 12/084; B05B 13/0431; B05C 11/023; B05C 5/0216
(Continued)

(56) References Cited

U.S. PATENT DOCUMENTS 5,370,905 A 12/1994 Varga et al.
6,001,181 A * 12/1999 Bullen ..... B05C 5/0216 118/323
(Continued)

FOREIGN PATENT DOCUMENTS

DE 42 22 122 A1 1/1994
JP 40-12155 Y 5/1940
(Continued)

OTHER PUBLICATIONS

International Search Report for corresponding International Application No. PCT/JP2015/000727, dated May 19, 2016.
(Continued)

*Primary Examiner* — Yewebdar T Tadesse
(74) *Attorney, Agent, or Firm* — Renner, Otto, Boisselle & Sklar, LLP

(57) ABSTRACT

Provided is an application device for applying and spreading an application liquid to and on a predetermined application area of a target surface, which is capable of smearing the application liquid on the application area. The application device (D) includes a brush unit (4) having a brush bristle bundle (41*a*), and performs a step of causing, while moving a nozzle orifice (32*a*) of a dispenser (3) along at least a portion of the surface of a rivet (S1) and an area of a wall (Sp) surrounding the base of the rivet (S1), a sealing liquid to be ejected from the nozzle orifice (32*a*) and to adhere to the portion, and thereafter, a step of spreading the adhering sealing liquid by causing the brush bristle bundle (41*a*) to
(Continued)

slide on the surface of the rivet (S1) and the area of wall (Sp) surrounding the base of the rivet (S1).

6 Claims, 4 Drawing Sheets

(51) Int. Cl.
*B05C 11/02* (2006.01)
*B05C 11/10* (2006.01)
*A46B 13/02* (2006.01)
*B05B 12/08* (2006.01)

(52) U.S. Cl.
CPC ..... *B05B 13/0431* (2013.01); *B05C 11/023* (2013.01); *B05C 11/1013* (2013.01); *B05C 11/101* (2013.01); *B05C 11/1018* (2013.01)

(58) Field of Classification Search
USPC ..... 118/206, 410, 323, 304; 425/163; 156/578
See application file for complete search history.

(56) References Cited

U.S. PATENT DOCUMENTS 6,197,115 B1 * 3/2001 Barrey ..... B05C 11/10 118/500
2006/0051493 A1 * 3/2006 Tella ..... B01J 19/0046 427/2.1
2009/0250003 A1 * 10/2009 Umezawa ..... B05B 3/1057 118/302
2009/0304930 A1 12/2009 Chaimberg

FOREIGN PATENT DOCUMENTS

| | | | |
|---|---|---|---|
| JP | 56-24990 | Y | 6/1981 |
| JP | 57-167760 | A | 10/1982 |
| JP | 59-61878 | U | 4/1984 |
| JP | 59-158473 | A | 10/1984 |
| JP | 60-61072 | A | 4/1985 |
| JP | 62-9985 | Y | 3/1987 |
| JP | 62-183585 | U | 11/1987 |
| JP | H1-249164 | A | 10/1989 |
| JP | H1-304078 | A | 12/1989 |
| JP | 04-100558 | | 4/1992 |
| JP | 10-151402 | A | 6/1998 |
| JP | 2008-253876 | A | 10/2008 |
| JP | 2009-268998 | A | 11/2009 |

OTHER PUBLICATIONS

Form PCT/ISA/237 for corresponding International Application No. PCT/JP2015/000727, dated May 19, 2016.
European Office Action dated Feb. 20, 2018 corresponding to application No. 15 769 286.4.

* cited by examiner

APPLICATION DEVICE

TECHNICAL FIELD

The present disclosure relates to an application device configured to apply an application liquid to a workpiece, and in particular, to an application device configured to apply and spread an application liquid to and on a predetermined application area of a target surface.

BACKGROUND ART

Patent Document 1 discloses an example of application devices, which is configured to manufacture a photosensitive drum by forming a thin film on the outer peripheral surface of a cylindrical workpiece. This application device includes a rotation means that holds the cylindrical workpiece horizontally and rotates the same. While this rotation means is rotating the cylindrical workpiece at a high speed, an application liquid is ejected to the workpiece in a radial direction from a needle that is moved in the axial direction of the workpiece. In this manner, the application device evenly applies the application liquid to the outer peripheral surface of the workpiece.

Patent Document 2 describes another example of application devices, which is configured to apply a resist to a predetermined location of a target. To apply the resist to the outer surface of a box-shaped workpiece having a projection projecting vertically, this application device positions its doglegged needle such that the needle tip horizontally faces the outer surface of the workpiece, and ejects the resist from the needle tip while moving the needle along the outer surface of the workpiece. In this manner, the application device applies the resist to the outer surface of the workpiece.

CITATION LIST

Patent Document

Patent Document 1: Japanese Unexamined Patent Publication No. 2009-268998

Patent Document 2: Japanese Unexamined Patent Publication No. H04-100558

SUMMARY OF THE INVENTION

Technical Problem

Meanwhile, each of the application devices described in the above patent documents is merely capable of ejecting the application liquid from the needle and causing the ejected application liquid to adhere to the surface of the workpiece. However, it is sometimes necessary not only to cause a sealing liquid having a predetermined viscosity (a viscosity approximate to that of mayonnaise) to adhere to the surface of a workpiece, but also to smear the adhering sealing liquid on the surface to increase the adhesion of the sealing liquid, for example. Recently, there is an increasing demand for automation of these process steps in order to improve the process efficiency and provide uniform quality.

In view of the foregoing background, it is therefore an object of the present disclosure to provide an application device capable of smearing an application liquid on a predetermined application area of a target surface.

Solution to the Problem

The inventors of the present application have developed an application device including a brushing means, and configured to perform successively steps of causing a predetermined amount of an application liquid to adhere to a target surface, and spreading the adhering application liquid on a predetermined application area of the target surface by sliding a brush bristle bundle of the brushing means on the target surface.

Specifically, the present disclosure relates to an application device for applying and spreading a paste-like application liquid to and on a predetermined application area of a target surface. This application device includes: an application liquid feeder having a dispenser configured to eject the application liquid from a nozzle orifice; a brushing means having a brush bristle bundle and spreading the application liquid on the target surface; and a controller configured to control operations of the application liquid feeder and the brushing means.

The controller performs successive steps of: ejecting a predetermined amount of the application liquid from the nozzle orifice to the target surface, while moving the nozzle orifice within the application area of the target surface, thereby causing the application liquid to adhere to the target surface; and spreading the application liquid, which has adhered to the target surface, on the predetermined application area by causing the brush bristle bundle to slide on the target surface.

The "target surface" as used herein means a surface where the application device applies and spreads the application liquid, and includes at least a flat surface and a curved surface, in terms of shape. For example, the "target surface" includes the surface of a rivet projecting perpendicularly from a wall, an area of the wall surrounding the base of the rivet, and a boundary of metallic plates coupled to each other.

The "paste-like application liquid" as used herein refers to an application liquid having predetermined viscosity and flowability. For example, the "paste-like application liquid" may have a relatively high viscosity of approximately 15-35 Pa·s, and may include a sealing liquid which hardens with time at room temperature.

The "brush bristle bundle" as used herein refers to a bundle of a large number of fibers which are flexible to the extent that they are deformed upon touching a target surface and do not scratch the target surface.

With this configuration, the application device first actuates the application liquid feeder to cause a predetermined amount of the application liquid to adhere to the application area of the target surface, and then, moves the brushing means to cause the brush bristle bundle to slide on the target surface. This sliding of the brush bristle bundle smears the application liquid, which has been caused to adhere in advance, on the target surface. Thus, the application liquid that has been caused to adhere by the application liquid feeder may be smeared and spread on a predetermined application area of the target surface by the brushing means.

Since the actuation of the application liquid feeder to cause the application liquid to adhere precedes the actuation of the brushing means to smear the application liquid, the amount of the application liquid spread on the target surface is stabilized, which provides an advantage in providing uniform quality.

The brush bristle bundle of the brushing means may be configured as a rotary brush attached to an end of a rotatable shaft.

With this configuration in which the brush bristle bundle is configured as a rotary brush which is capable of rotating around the rotational axis extending along the shaft of the brush means (in other words, which is capable of spinning around the shaft), the brush bristle bundle repeatedly comes into contact with the target surface along with its spin when sliding on the target surface. This provides an advantage that the application liquid may be smeared evenly and stably on the target surface.

The brushing means may be configured such that a rotational speed and a rotational direction of the rotary brush are variable.

With this configuration in which the speed and direction of the spin of the rotary brush are variable, the movement of the rotary brush may be adjusted in accordance with the shape of the target surface and other factors. This provides an advantage in smearing of the application liquid on the target surface.

The brushing means may comprise a plurality of brushing means which are of different types and have brush bristle bundles in different shapes.

With this configuration, the brush means may be changed in accordance with the shape of the target surface or other factors. This provides an advantage in smearing the application liquid on the target surface.

The dispenser and the brushing means may be mounted to a distal end of an arm of an articulated robot.

In this configuration, the dispenser and the brushing means are mounted to an arm of an articulated robot. The dispenser and, for example, an air supply tube externally attached to the dispenser form an application liquid feeder. By operating the arm, the dispenser and the brushing means are moved with respect to the target surface. Thus, the position and orientation of the dispenser and those of the brushing means may be adjusted in accordance with the position relationship between the target surface and each of the dispenser and the brushing means.

The application liquid may be configured as a liquid which hardens with time. The application liquid feeder may be configured to adjust an ejection amount of the application liquid to be ejected from the nozzle orifice by regulating an ejection pressure applied to the application liquid contained in the dispenser. The application device may include an ejection amount measurer configured to measure the ejection amount of the application liquid ejected from the nozzle orifice. The application liquid feeder may periodically measure an ejection amount of the application liquid actually ejected from the nozzle orifice, and corrects the ejection pressure in accordance with measurement results.

If the ejection amount of the application liquid to be ejected from the nozzle orifice was adjusted by regulating the ejection pressure applied by the dispenser to the application liquid, hardening of the application liquid would reduce the ejection amount resulting from the application of the same ejection pressure.

The above configuration, in which the ejection amount of the application liquid actually ejected from the nozzle orifice is periodically measured and the ejection pressure of the dispenser is corrected in accordance with the measurement results, enables a predetermined amount of the application liquid to be ejected toward the target surface even if the application liquid is configured to harden with time.

Advantages of the Invention

As can be seen from the foregoing, an application device including a brushing means first causes a predetermined amount of an application liquid to adhere to a target surface, and then, a brush bristle bundle of the brushing means is caused to slide on the target surface, thereby spreading the adhering application liquid on a predetermined application area of the target surface. This provides an advantage in smearing the application liquid on the target surface.

DESCRIPTION OF EMBODIMENTS

Figure 1:
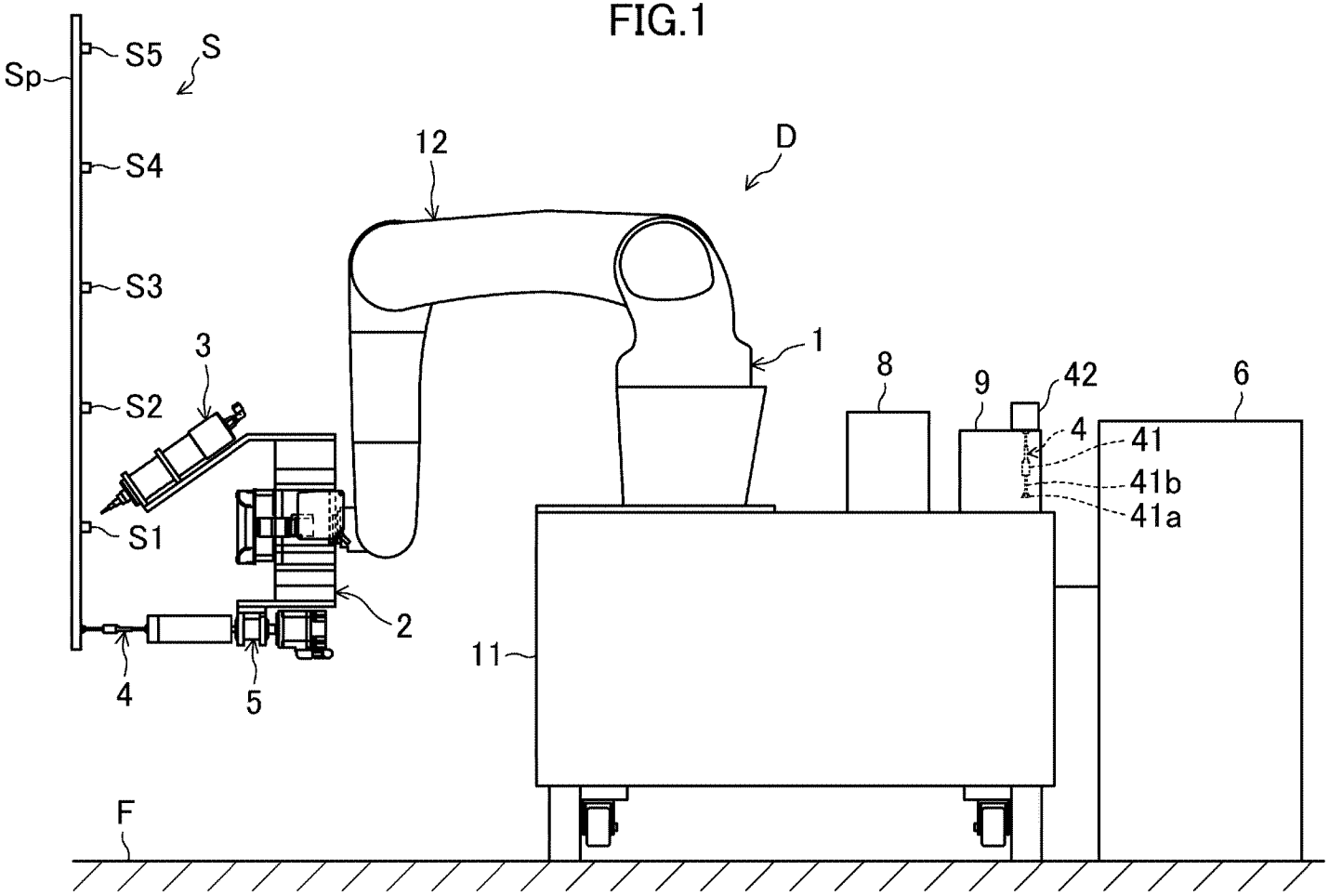
FIG. 1 is an external view showing an overall configuration for an application device, with some parts omitted.
Figure 3:
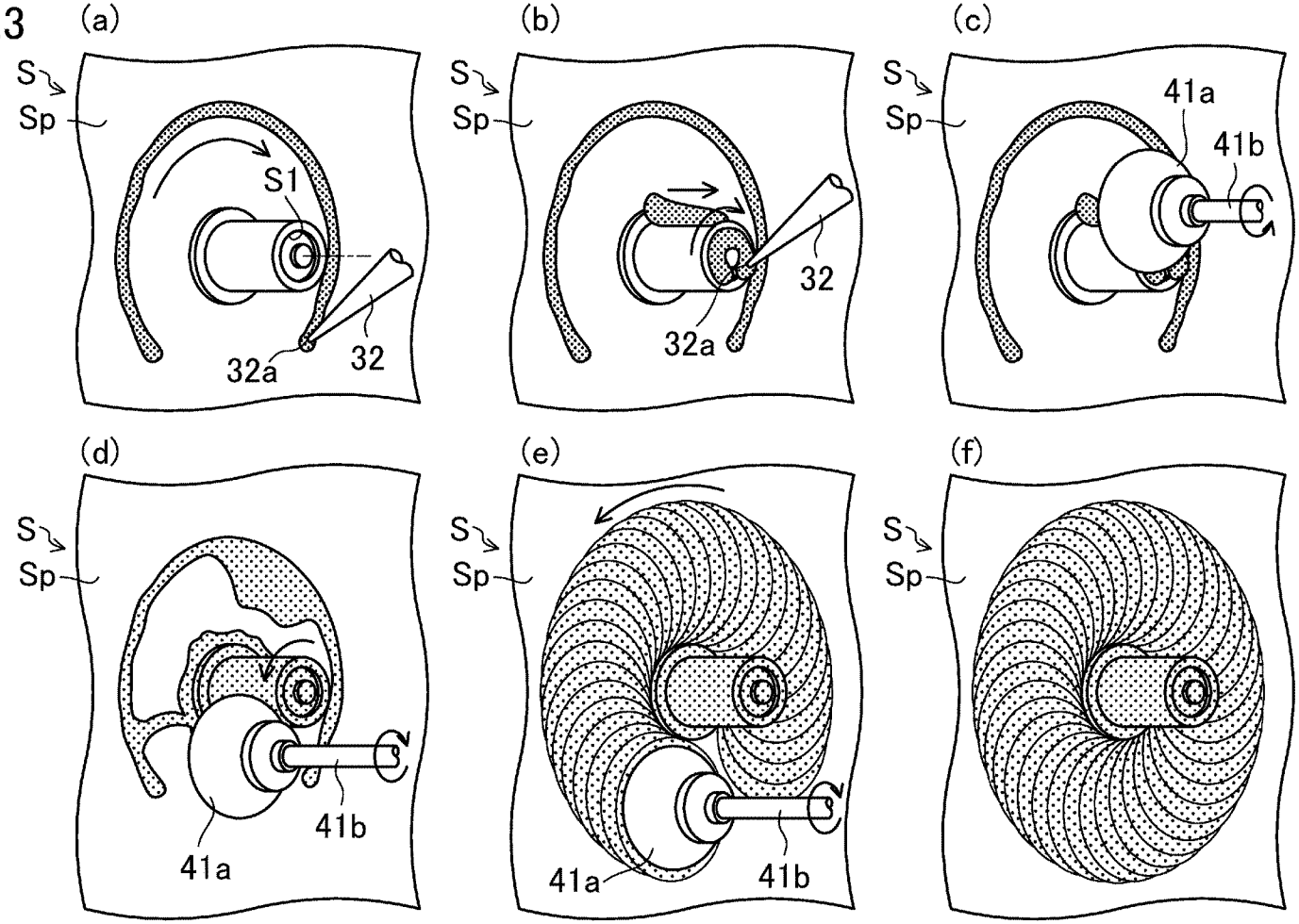
FIG. 3 shows process steps in which an application device applies an application liquid to a rivet.

Embodiments of an application device will be described below with reference to the drawings. The application device described herein is an example. FIG. 1 shows an overall configuration for an application device. Here, this application device D is configured to apply and spread an application liquid configured as a sealing liquid to and on predetermined application areas of target surfaces which are elements of a structure S having a predetermined shape. In this embodiment, a vertical surface of a wall Sp which is a component of an aircraft and is comprised of a plurality of plate members stacked together, and the surfaces of the heads of rivets S1-S5 (denoted as S1, S2, S3, S4 and S5 sequentially from bottom-to-top direction in the figure) which project from the vertical surface and are arranged at predetermined intervals vertically in the figure are described as examples of such target surfaces. Hereinafter, the vertical surface of the wall Sp is simply referred to as the wall Sp. As shown in FIG. 3, the head of each rivet has a substantially cylindrical shape and extends perpendicularly to the wall Sp. In this embodiment, examples of the predetermined application area of the target surface include the entire surface of the head of each of the rivets S1-S5 and an area of the wall Sp surrounding the base of each head. The heads of the rivets S1-S5 may have the same diameter or different diameters. For the sake of simplification, hereinafter, the "heads of the rivets S1-S5" are simply referred to as the "rivets S1-S5."

In the following, unless otherwise specified, the description is given to, for example, the movement and arrangement of the components of the application device D in the case where the entire surface of the rivet S1, in particular, among the rivets S1-S5 and the area of the wall Sp that surrounds the base of the rivet S1 are determined to be the application area. For the sake of simplification, "to spread the sealing liquid on the surface of the rivet S1 and the area of the wall Sp surrounding the base of the rivet S1" may be simply described as "to spread the sealing liquid on the rivet S1" hereinafter. Other examples of the target surfaces and application areas will be described later.

This application device D includes an articulated robot 1 (hereinafter, also abbreviated as the robot), a tool unit 2 which is mounted to the robot 1 and includes various mechanisms and detectors 71 and 72, a dispenser 3 supported on the tool unit 2, and a brush operation mechanism 5 to which a brush unit 4 is attached, an ejection amount meter 8 and a brush replacer 9 which are arranged on a casing 11, and a control unit 6 functioning as a control means. The control unit 6 is electrically connected at least to the robot 1 and the tool unit 2, calculates various control parameters based on information acquired from the detectors 71, 72 and the ejection amount meter 8 and external inputs, and actuates the robot 1, the tool unit 2, the dispenser 3, the brush operation mechanism 5, and other components based on the calculated parameters.

In the following, main portions of each of the robot 1, the tool unit 2, the dispenser 3, the brush unit 4, and other components that form the application device D will be described. Note that some of the parts having known configurations will not be shown or described.

The robot 1 of this embodiment is configured as an industrial robot including the casing 11 to be installed on a floor F, and an articulated arm 12 extending from the top of the casing 11. This industrial robot has a known structure.

For example, the arm 12 forms part of a vertical articulated robot of a six-axis system, as schematically shown in FIG. 1. The axes of the arm 12 are connected to each other via pivots. The axes are each capable of turning in a predetermined direction, and are connected to each other via known power transmission mechanisms. The robot 1 transmits power supplied by a drive installed in the casing 11 from one axis functioning as the proximal end to another functioning as the wrist (i.e., the distal end), and thereby operates the axes as necessary. The tool unit 2 is mounted to the axis of the robot 1 functioning as the wrist (hereinafter, referred to simply as the distal axis), and the robot freely changes the position and orientation of the tool unit 2 within the operating area of the robot 1.

Figure 2:
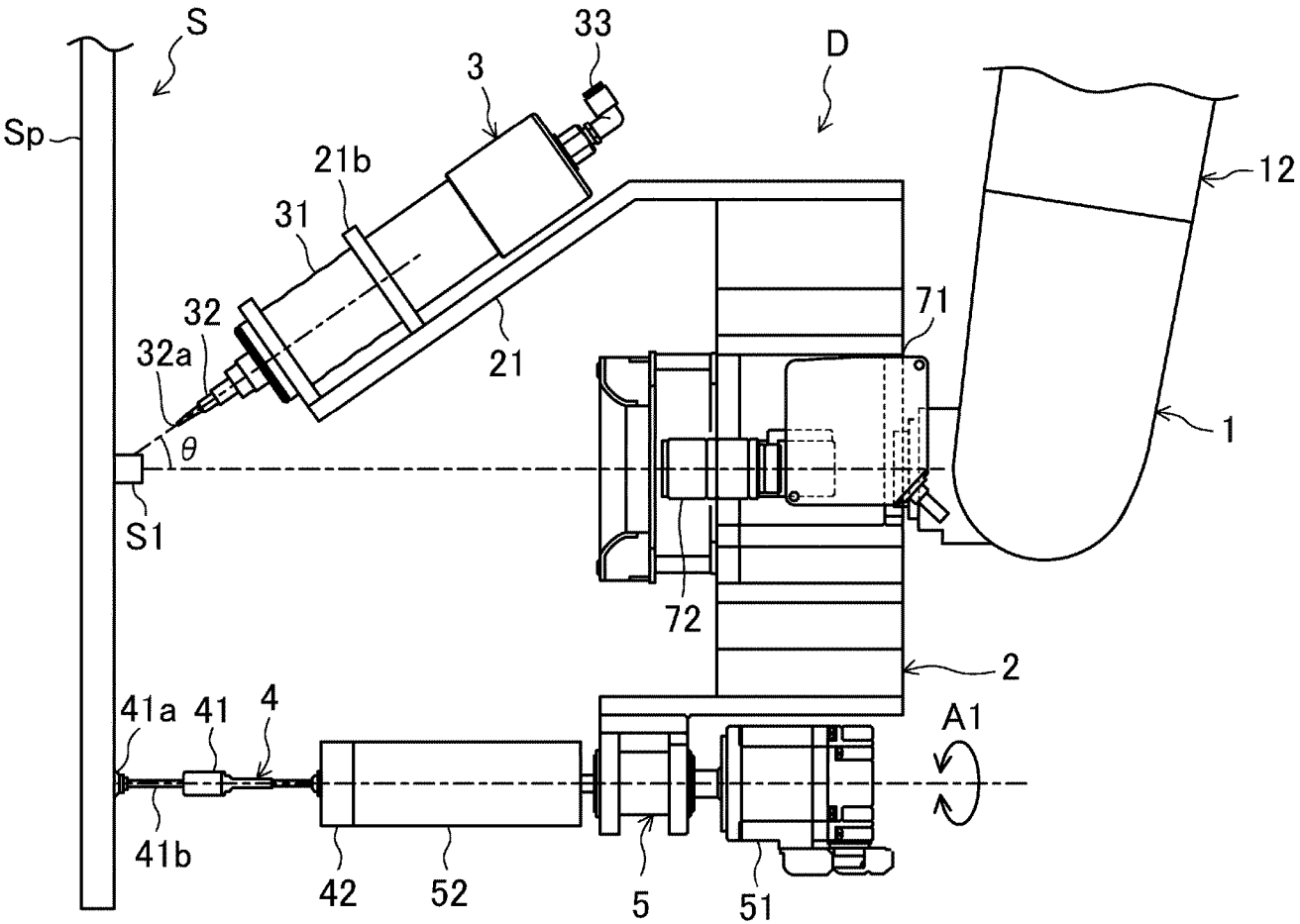
FIG. 2 shows, on an enlarged scale, a tool unit forming part of an application device, with some parts omitted

As shown in FIG. 2, to cause a sealing liquid to adhere to the rivet S1, the distal axis of the robot 1 is oriented toward the rivet S1, and then positioned such that the top surfaces of the distal axis and the rivet S1 (i.e., the top surfaces of the distal axis and the wall Sp) become parallel to each other, according to a manner which will be described later. Further, the robot 1 holds the distal axis such that a straight line extending perpendicularly from the center of the top surface of the distal axis is coaxial with the center axis of the rivet S1 (i.e., the axis passing through the center of the top surface of the rivet S1 and extending perpendicularly to the top surface and the wall Sp). From this basic arrangement, the robot 1 is operated.

The tool unit 2 is provided with a support arm 21 which supports the dispenser 3 in a detachable manner. Specifically, as shown in FIG. 2, the support arm 21 is provided to extend obliquely from the body of the tool unit 2, more precisely, from an end portion of the arm 12 toward the rivet S1. The support arm 21 has, on its end portion, a support section 21*b* which supports the dispenser 3 in a detachable manner.

In this embodiment, the dispenser 3, an air supply tube, a pressure regulator, and the control unit 6 form an application liquid feeder configured to feed a predetermined amount of the sealing liquid to a predetermined location. A known dispenser is adopted as the dispenser 3. Specifically, the dispenser 3 is in a substantially cylindrical shape, and includes a syringe 31 which is filled with the sealing liquid, a nozzle 32 provided at an end of the syringe 31 and ejecting the sealing liquid from its nozzle orifice 32*a* formed at an end thereof, and a valve 33 provided at the other end of the syringe 31 and connected to the air supply tube.

As shown in FIG. 2, the dispenser 3 is supported such that its longitudinal direction is parallel to the longitudinal direction of the support arm 21. Further, the syringe 31 is detachably held by the support section 21*b* in such a position that when the top surface of the distal axis is oriented toward the top surface of the rivet S1, the end of the syringe 31, i.e., the end at which the nozzle 32 is provided, is oriented toward the wall Sp.

When the application device D is operated, the control unit 6 outputs a control signal to the pressure regulator coupled to the air supply tube and causes the pressure regulator to regulate the pressure (the ejection pressure) of pressurizing air to be applied to the sealing liquid with which the syringe 31 is filled. The application device D supplies the regulated pressurizing air to the inside of the syringe 31, thereby ejecting the sealing liquid from the nozzle orifice 32*a* opening at the end of the nozzle 32. Thus, the application device D is configured not only to eject the sealing liquid by supplying the pressurizing air, but also to adjust the amount of the sealing liquid to be ejected by regulating the ejection pressure.

Note that a known sealing liquid is used as the sealing liquid with which the syringe 31 is filled. In this embodiment, for example, a so-called frozen sealant (a sealant which is comprised of a mixture of a chief material and a hardening agent, and which is frozen for storage) is used after being defrosted. That is to say, a sealant that has been frozen for storage is defrosted to be used in this embodiment. This frozen sealant is prepared such that it hardens as time passes (hereinafter, also described simply as "hardens with time") once it is defrosted, and is in a paste state when it is going to be applied to a workpiece by an application device. Specifically, the sealant has viscosity and flowability which are approximate to those of mayonnaise when it is going to be applied. In particular, its viscosity is relatively high and in the range of 15-35 Pa·s.

The dispenser 3 has its center axis that extends on the same plane on which a straight line perpendicular to the top surface of the distal axis extends, and that is inclined relative to the straight line. The inclination angle θ representing how much the center axis is inclined relative to the straight line is adjusted by altering, for example, the structures of the support arm 21 and the support section 21*b*, and chosen from, for example, the range of approximately 20-50° in accordance with the configuration for the structure S, the arrangement of the rivets S1-S5, and other factors. In this embodiment, the inclination angle θ is set to be 35°. This inclination angle enables not only the nozzle orifice 32*a* to be brought close to the outer peripheral surface of the base of the rivet S1 and the area of the wall Sp surrounding the base of the rivet S1 without causing interference between the dispenser 3 and the structure S, but also the sealing liquid ejected from the nozzle orifice 32*a* to adhere stably to the outer peripheral surface and the wall Sp to which the nozzle orifice 32*a* has been brought close.

In this embodiment, the brush unit 4 and the brush operation mechanism 5 form a brushing means configured to spread the sealing liquid on a predetermined location. The brush operation mechanism 5 is provided to the tool unit 2, and formed such that its end extends perpendicularly to the wall Sp when the top surfaces of the distal axis and the rivet Si face each other and are parallel to each other as shown in FIG. 2. This brush operation mechanism 5 has, near its base end, a brush drive 51 including a motor therein. The brush drive 51 generates rotary force acting around a rotational axis which extends in the longitudinal direction of the brush operation mechanism 5. The brush operation mechanism 5 also has, near its end, a brush-attaching section 52 to which the brush unit 4 is attached. The brush-attaching section 52 has a substantially cylindrical shape having an opening at its end. This opening holds the brush unit 4. The brush-attaching section 52 is configured to be rotated, integrally with the brush unit 4 held by its opening, by the rotary force generated by the brush drive 51.

The brush unit 4 includes a brush body 41 which is configured as a known brush and a fitting section 42 attached to the base end of the brush body 41 and configured to be fitted in the opening of the brush-attaching section 52. The known brush used as the brush body 41 has a brush bristle bundle 41*a* configured as fibers (bristles) bundled in one of various shapes such as a bevel shape, a cup shape, an umbrella shape, and an end shape, and a shaft 41*b* functioning as a handle. The brush body 41 thus configured is mounted to the brush operation mechanism 5 by attaching the fitting section 42 to the shaft 41*b*, and then by fitting the fitting section 42 into the opening of the brush-attaching section 52. Thus, the brush body 41 is held by the opening. The brush bristle bundle 41*a* is configured as a rotary brush capable of rotating around the center axis of the shaft 41*b*. The brush operation mechanism 5 actuates the brush drive 51 in response to a control signal from the control unit 6 such that the brush-attaching section 52, the fitting section 42, and the brush body 41 are integrally rotated around the center axis of the shaft 41*b* in the direction indicated with the arrow Al in FIG. 2 (hereinafter, this rotation is also referred to as spin). The rotational direction (i.e., the clockwise direction or the counterclockwise direction) and the rotational speed can be varied as appropriate in response to a control signal from the control unit 6.

The fibers forming the brush bristle bundle 41*a* is chosen from materials which are flexible to the extent that they are deformed upon touching the wall Sp or the rivet S1 and do not scratch the touched portion. Examples of such materials include synthetic resin and animal fibers.

The tool unit 2 includes a laser length measuring machine 71. This laser length measuring machine 71 is a known machine, and is mounted such that its laser oscillator is oriented toward the structure S (i.e., toward the left in FIG. 1) in the direction perpendicular to the top surface of the distal axis (i.e., in the direction in which the rotational axis of the brush unit 4 extends). The laser length measuring machine 71 oscillates a laser toward a predetermined location of the wall Sp in response to a control signal from the control unit 6, and measures the distance between the predetermined location and the laser oscillator. The laser length measuring machine 71 then outputs data of the measured distance to the control unit 6.

The tool unit 2 includes a single-lens camera 72. A known camera is used as the single-lens camera 72, and is mounted such that its lens is oriented toward the structure S (i.e., toward the left in FIG. 1) in the direction perpendicular to the top surface of the distal axis (i.e., in the direction in which the rotational axis of the brush unit 4 extends). The single-lens camera 72 captures an image of a predetermined one of the rivets S1-S5 in response to a control signal from the control unit 6, and outputs data of the captured image to the control unit 6.

As described previously, the robot 1 freely changes the position and orientation of the tool unit 2 within the operating area of the robot 1. Therefore, the position and orientation of each of the dispenser 3 and the brush unit 4 supported on the tool unit 2 are also freely changed, with respect to the wall Sp or the rivet S1, in accordance with the movement of the robot 1 functioning as a moving means (specifically, the movement of the axes forming the arm 12). The manner to change the position and orientation is also freely changeable within the range allowable for the robot 1. An exemplary manner to change the position is as follows. A combination of movement in a circumferential direction around the center axis of the rivet S1 (hereinafter the movement in this circumferential direction is referred to as the revolution), movement in the radial direction of the revolution, and movement in the direction of the center axis of the revolution (i.e., the direction in which the rivets S1-S5 project; hereinafter this direction is referred to as the pitch direction) is combined with movement which the center of the revolution makes due to movement of the entire tool unit 2 along the wall Sp (hereinafter the direction of this movement is referred to also as wall direction), thereby positioning these components. The method of changing the positions is altered as appropriate in accordance with a target surface and the shape of an application area on the target surface.

The brush unit 4 of the application device D is replaceable. In the operating area of the robot 1, for example, on the casing 11, the brush replacer 9 is provided for replacing the brush unit 4. Multiple brush units 4 of which the brush bodies 41 have different shapes and the fitting sections 42 are in the same shape are inserted in the top face of the brush replacer 9 with the fitting sections 42 facing upward in the figure. The top face of the brush replacer 9 also has space in which the brush unit 4 is detached.

Note that the application device D includes the ejection amount meter 8 as an ejection amount measurer. In this embodiment, the ejection amount meter 8 is arranged on the casing 11. The ejection amount meter 8 is configured to allow the nozzle 32 of the dispenser 3 to be inserted therein via the movement of the arm 12. The ejection amount meter 8 measures the weight of the sealing liquid ejected from the nozzle 32 thus inserted, and outputs data of the measured weight to the control unit 6.

In the following, a main configuration for the control unit 6 functioning as a controller for controlling the robot 1, the tool unit 2, and other components is described as an example. Note that some of parts having known configurations will not be shown or described.

The control unit 6 receives at least the distance data from the laser length measuring machine 71, the image data from the single-lens camera 72, and the weight data from the ejection amount meter 8.

The control unit 6 functions as a man-machine interface and includes, for example, a display section comprised of a liquid crystal panel, and an input section comprised of a key pad and other components. Thus, the control unit 6 is configured such that various setting parameters for controlling the operation of the application device D can be input, and the input setting parameters and the data acquired by the detectors 71 and 72, the ejection amount meter 8, and other components can be displayed.

The control unit 6 carries out various calculations based on the input data as described above and the various setting parameters designated via the input section, and outputs control signals based on the results of the calculations to actuate the components of the application device D. For example, the control unit 6 outputs control signals for controlling the operations of the axes and the brush operation mechanism 5 and the ejection pressure of the dispenser 3 to the associated components.

Based on the distance data from the laser length measuring machine 71, the control unit 6 detects an inclination of the arranged wall Sp relative to the vertical direction and the distance between the robot 1 and the wall Sp. The control unit 6 adjusts the position and orientation of the tool unit 2 in accordance with the detected inclination.

The control unit 6 calculates the inclination and the distance that represent a positional relationship, using a known method. For example, acquiring distance data of three arbitrary points on the wall Sp enables detection of the inclination of the wall Sp and the distance to the wall Sp.

Based on the image data from the single-lens camera 72, the control unit 6 detects displacements of the wall Sp in the vertical, horizontal and rotational directions with respect to the preset proper position, using a known method. The control unit 6 carries out, in accordance with the detected displacements, fine adjustment of the positions of the nozzle orifice 32*a* and the brush bristle bundle 41*a* for applying the sealing liquid, as will be described later.

Based on the image data from the single-lens camera 72, the control unit 6 also analyzes the data of the captured image of the rivet S1 to detect the center axis of the rivet S1, using a known method. The control unit 6 then outputs control signals to the robot 1 and the tool unit 2, thereby positioning the tool unit 2 based on the detected center axis.

Further, the control unit 6 periodically detects the amounts of the sealing liquid ejected from the nozzle 32 by means of the ejection amount meter 8 during the process of applying the sealing liquid to the rivets S1-S5. Specifically, an amount of the sealing liquid to be ejected to the rivet S1 first is predetermined. The control unit 6 applies a first ejection pressure to cause the nozzle 32 to eject a smaller amount of the sealing liquid than the predetermined amount, and measures the amount of the thus ejected sealing liquid. Further, the control unit 6 applies a second ejection pressure to cause the nozzle 32 to eject a larger amount of the sealing liquid than the predetermined amount, and measures the amount of the thus ejected sealing liquid. Thus, based on the first and second ejection pressures and the amounts of the actually ejected sealing liquid, the relationship between the applied ejection pressures and the ejection amounts is determined by, for example, straight-line approximation. As previously described, since the sealing liquid hardens with time, even if the same ejection pressure is applied, an amount ejected after elapse of time may be smaller than an amount ejected at a first stage. The control unit 6 periodically determines the relationship between applied ejection pressures and ejection amounts, and regulates the ejection pressure based on the determined relationship. Thus, a predetermined amount of the sealing liquid may be accurately ejected to each of the rivets S1-S5. This configuration is remarkably effective when the application device D needs to be operated for a certain period of time, as in the above case where the sealing liquid is applied to the plurality of rivets S1-S5.

(Process Steps of Applying Sealing Liquid to Rivet by Application Device)

Process steps in which the application device D applies a sealing liquid to the rivet S1 will be described below.

First, the wall Sp is arranged at a preset proper position. Thereafter, the application device D is arranged in accordance with an application target portion of the wall Sp. As will be described later, an inclination and a displacement of the wall Sp are detected and corrected, and a small displacement in the arrangement of the wall Sp is thus allowable.

When the application device D starts to operate, the control unit 6 of the application device D actuates the robot 1 and the laser length measuring machine 71 and causes them to measure distances between the wall Sp and the tool unit 2 at three predetermined points on the wall Sp (for example, three points designated by an operator via the input section).

The control unit 6 calculates the positional relationship between the wall Sp and the tool unit 2 based on the data of the measured distances, and actuates the robot 1 to adjust the orientation of the tool unit 2 such that the top surface of the distal axis becomes parallel to the wall Sp, and to move the entire tool unit 2 in the pitch direction such that the tool unit 2 is at a distance suitable for the application.

The control unit 6 actuates the robot 1 and the single-lens camera 72 to capture images of predetermined two of the rivets arranged on the wall Sp (for example, the rivets S1 and S5 designated in advance by the operator via the input section).

The control unit 6 calculates the positions of the rivets S1 and S5 based on the data of the captured images, and compares the calculation results with the previously stored position data of the rivets S1 and S5, thereby determining displacements of the wall Sp in the vertical, horizontal, and rotational directions.

The control unit 6 actuates the robot 1 to bring the tool unit 2 close to the rivet S1, and causes the single-lens camera 72 to capture an image of the rivet S1 again.

The control unit 6 detects the position of the center axis of the rivet S1 that is the application target based on the data of the captured image, and actuates the robot 1 based on the detected center axis to move the tool unit 2 in the wall direction, thereby positioning the tool unit 2. In this embodiment, as a result of this positioning, the straight line extending perpendicularly from the top surface of the distal axis becomes coaxial with the center axis of the rivet S1, as in the state shown in FIG. 2. From this basic arrangement resulting from this positioning, the tool unit 2, the dispenser 3, and the brush unit 4 are operated.

First, a step in which the dispenser 3 causes the sealing liquid to adhere to the rivet S1 is described with reference to Sections (a) and (b) of FIG. 3.

The control unit 6 operates, by actuating the robot 1, the dispenser 3 to cause a predetermined amount of the sealing liquid to adhere to the surface of the rivet S1 and the area of the wall Sp surrounding the base of the rivet S1. This operation is carried out in response to control signals output from the control unit 6. However, in the following description, such signals and the actuation of the robot 1 may be omitted as appropriate.

Specifically, the nozzle orifice 32*a* of the dispenser 3 is brought close to the area of the wall Sp surrounding the base of the rivet S1, and the dispenser 3 is moved around the center axis of the rivet S1 such that the nozzle orifice 32*a* is moved in the circumferential direction of the rivet S1 along the wall Sp. When the dispenser 3 is being moved, the sealing liquid is ejected from the nozzle orifice 32*a* toward the wall Sp. Consequently, as shown in Section (a) of FIG. 3, the sealing liquid adheres, following the trajectory of the nozzle orifice 32*a*, to the area of the wall Sp surrounding the base of the rivet S1.

Thereafter, the nozzle orifice 32*a* of the dispenser 3 is brought close to an upper portion of the outer peripheral surface of the base of the rivet S1. The dispenser 3 is moved in the pitch direction such that the nozzle orifice 32*a* is moved along the upper portion of the outer peripheral surface of the rivet S1 in the pitch direction. During the dispenser 3 is being moved, the sealing liquid is ejected from the nozzle orifice 32*a* toward the outer peripheral surface of the rivet S1. Consequently, as shown in Section (b) of FIG. 3, the sealing liquid adheres, following the trajectory of the nozzle orifice 32*a*, to the upper portion of the outer peripheral surface of the rivet S1, from the base to the tip.

Finally, the nozzle orifice 32*a* of the dispenser 3 is brought close to the top surface of the rivet S1. The dispenser 3 is moved around the center axis of the rivet S1 such that the nozzle orifice 32*a* is moved in the circumferential direction of the rivet S1 along the top surface of the rivet S1. When the dispenser 3 is being moved, the sealing liquid is ejected from the nozzle orifice 32*a* toward the top surface of the rivet S1. Consequently, as shown in Section (b) of FIG. 3, the sealing liquid adheres, following the trajectory of the nozzle orifice 32*a*, to the top surface of the rivet S1.

When the sealing liquid is caused to adhere to the area of the wall Sp surrounding the base of the rivet S1, the outer peripheral surface of the rivet S1, and the top surface of the rivet S1, the orientation of dispenser 3 is maintained unchanged with respect to the wall Sp or the rivet S1. Specifically, the top surface of the distal axis, the top surface of the rivet S1, and the wall Sp are continuously oriented parallel to each other, and consequently, the inclination (the inclination angle θ) of the dispenser 3 with respect to the wall Sp is maintained unchanged.

In this embodiment, when the sealing liquid is caused to adhere to the rivet S1, the brush operation mechanism 5 has the brush unit 4 detached therefrom. Therefore, when the dispenser 3 is being moved, no interference occurs between the brush unit 4 and the wall Sp.

Next, a step in which the sealing liquid is smeared on the rivet S1 with the brush unit 4 is described with reference to Sections (c)-(f) of FIG. 3.

The control unit 6 operates, by actuating the robot 1, the brush operation mechanism 5 to smear the sealing liquid, which has been caused by the dispenser 3 to adhere, on the surface of the rivet S1 and the area of the wall Sp surrounding the base of the rivet S1. This operation is carried out in response to control signals output from the control unit 6. However, in the following description, such signals and the actuation of the robot 1 may be omitted as appropriate.

Specifically, the brush operation mechanism 5 is moved, and the brush-attaching section 52 is caused to hold the fitting section 42 of one of the brush units 4 arranged on the brush replacer 9. The following description is based on the use of the brush unit 4 of which the brush bristle bundle 41*a* is in a bevel shape.

After the brush unit 4 has been attached to the brush operation mechanism 5 in this manner, the brush unit 4 is moved toward the rivet S1 having the sealing liquid adhering thereto. The position and orientation of the brush unit 4 is adjusted such that the center axis of the shaft 41*b* becomes perpendicular to the wall Sp. Then, the brush drive 51 is actuated to rotate the brush unit 4 around the shaft 41*b*.

Next, as shown in Section (c) of FIG. 3, while the bristle ends of the brush bristle bundle 41*a* of the brush unit 4 that is spinning are being pressed onto the top surface of the rivet S1 to flatten the sealing liquid adhering to the top surface, the brush unit 4 is caused to make one revolution around the center axis of the rivet S1 such that the bristle ends slide on the top surface of the rivet S1 in the circumferential direction of the rivet S1. Thus, the brush bristle bundle 41*a* that is spinning and being pressed on the top surface of the rivet S1 slides in the circumferential direction, which results in that the sealing liquid is spread and smeared on the entire top surface of the rivet S1, as shown in Section (d) of FIG. 3.

Thereafter, as shown in section (d) of FIG. 3, while the outer side of the brush bristle bundle 41*a* that is continuously spinning is being pressed onto the upper portion of the outer peripheral surface of the base of the rivet 1 to flatten the sealing liquid adhering to the upper portion, the brush unit 4 is moved in the pitch direction from the base to the tip. During this movement, the brush unit 4 is caused to make several revolutions, for example, seven revolutions, around the center axis, such that the outer side of the brush bristle bundle 41*a* helically slides on the outer peripheral surface of the rivet S1. Thus, the brush bristle bundle 41*a* that is spinning and being pressed onto the outer peripheral surface of the rivet S1 helically slides on the outer peripheral surface, which results in that the sealing liquid is spread and smeared on the entire outer peripheral surface of the rivet S1, as shown in Section (e) of FIG. 3.

Thereafter, as shown in Section (e) of FIG. 3, while the bristle ends of the brush bristle bundle 41*a* that is continuously spinning are being pressed onto the area of the wall Sp surrounding the base of the rivet S1 to flatten the sealing liquid adhering to the area, the brush unit 4 is caused to make several revolutions, for example, four revolutions, around the center axis of the rivet S1 such that the bristle ends slide on the wall Sp in the circumferential direction of the rivet S1. Thus, the brush bristle bundle 41*a* that is spinning and being pressed onto the area of the wall Sp surrounding the base of the rivet S1 slides in the circumferential direction, resulting in that the sealing liquid is spread and smeared on the area of the wall Sp surrounding the base of the rivet S1, as shown in Section (f) of FIG. 3.

In this case, if the spin of the brush bristle bundle 41*a* around the shaft 41*b* and the revolutions of the brush bristle bundle 41*a* around the center axis of the rivet S1 are both in the clockwise direction (or the counterclockwise direction), as the brush bristle bundle 41*a* is moved along the wall Sp, the sealing liquid smeared on the wall Sp is easily gathered inwardly in the radial direction of the rivet S1, i.e., from the area surrounding the rivet S1 toward the vicinity of the base. Likewise, if the directions of the spin and the revolutions are opposite to each other (i.e., one is in the clockwise direction, and the other is in the counterclockwise direction), the sealing liquid is easily scraped outwardly in the radial direction of the rivet S1, i.e., from the vicinity of the base of the rivet S1 toward the surrounding area. In view of this, this embodiment is configured such that, while the brush unit 4 is caused to move along the wall Sp and make four revolutions around the center axis along the wall Sp, the brush bristle bundle 41*a* spins in the clockwise direction during the first two revolutions of the brush unit 4, and in the counterclockwise direction during the other two revolutions. This setting associated with the spin of the brush bristle bundle 41*a* is remarkably effective in a situation where the direction in which the brush unit 4 or the arm 12 is moved with respect to the target surface is limited.

In this embodiment, in order to secure that the sealing liquid is smeared on the wall Sp, the speed at which the brush bristle bundle 41*a* spins is greater when it slides on the wall Sp than when it slides on the outer peripheral surface and the top surface of the rivet S1.

Note that when the sealing liquid is smeared on the area of the wall Sp surrounding the base of the rivet S1, the outer peripheral surface and the top surface of the rivet S1, the orientation of the brush unit 4 with respect to the wall Sp or the rivet S1 is maintained unchanged (i.e., the brush unit 4 is maintained oriented such that the center axis of the shaft 41*b* is perpendicular to the wall Sp).

The trajectories of the dispenser 3 and the brush unit 4 are not limited to those described herein. For example, the sealing liquid may be smeared on the area of the wall Sp surrounding the base of rivet S1 first, and then, sequentially on the outer peripheral surface and the top surface of the rivet S1.

In this manner, as shown in Section (f) of FIG. 3, the sealing liquid is spread and smeared entirely on the surface of the rivet S1 and the area of the wall Sp surrounding the base of the rivet S1.

Next, a step in which the sealing liquid is smeared on the rivets S2-S5 subsequently to the rivet S1 is described.

After the sealing liquid is smeared entirely on the surface of the rivet S1 and the area of the wall Sp surrounding the base of rivet S1, the sealing liquid is applied to another rivet, for example, the rivet S2.

The robot 1 operates, based on position data input in advance, to move the tool unit 2 toward the rivet S2 that is a new application target.

Thereafter, the single-lens camera 72 captures an image of the rivet S2 that is the new application target. Based on the data of the captured image, the tool unit 2 is adjusted and positioned relative to the rivet S2, just like the positioning relative to the rivet S1.

Once the positioning of the tool unit 2 relative to the rivet S2 is completed, the dispenser 3, the brush operation mechanism 5, and other components are actuated as in the foregoing, and the sealing liquid is applied to, and spread and smeared entirely on, the surface and the area of the wall Sp surrounding the base.

These operations are repeated, thereby smearing the sealing liquid sequentially on the rivets S1-S5 attached to the wall Sp.

When a predetermined time (for example, a time previously input by the operator) has passed since the start of the operation of the application device D, the control unit 6 inserts the nozzle 32 in the ejection amount meter 8, and carries out the step of acquiring the relationship between the ejection pressures and the ejection amounts. Thus, the control unit 6 regulates the ejection pressure to cause a predetermined amount of the sealing liquid to be ejected from the nozzle orifice 32*a*.

(Process Step of Applying Sealing Liquid to Other Target Surfaces)

Figure 4:
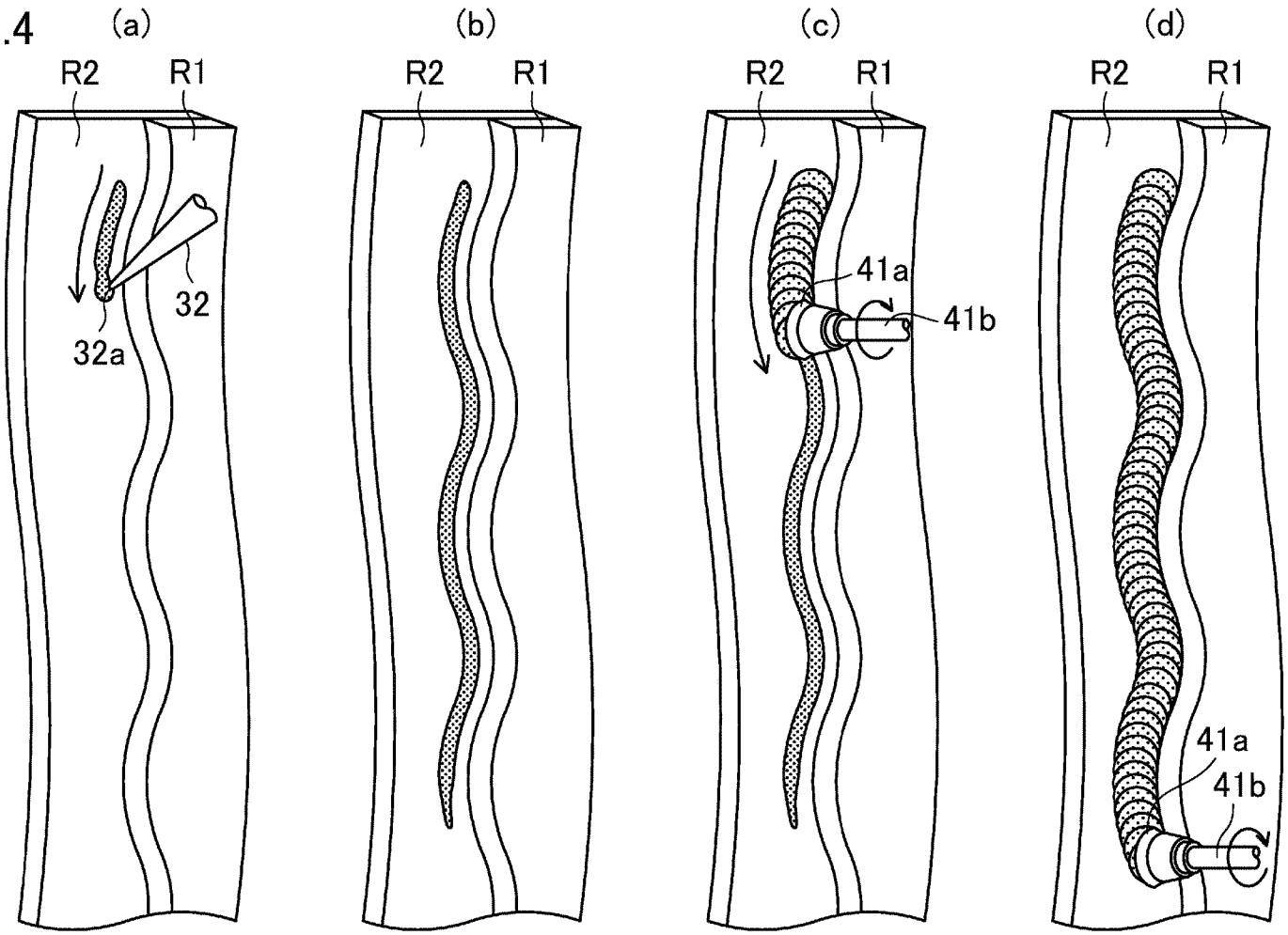
FIG. 4 shows process steps in which an application liquid is applied to another target surface.

FIG. 4 shows, as another exemplary target surface and as another exemplary application area of the target surface, plate-like members R1 and R2 (also referred to simply as the plates) which overlap with each other and are coupled to each other. A step in which a sealing liquid is smeared along the boundary between the plates R1 and R2 is now described. In this case, for example, the plate R1, which has a wavy edge, is placed on, and coupled to, the plate R2, and the sealing liquid is applied to and spread on the plate R2 along this wavy edge. The shape of the plate R1 is not limited to one with such a wavy edge, and may have a straight edge.

In this case, the plates R1 and R2 coupled together are arranged to stand on a floor F at a predetermined proper position. As described above, an inclination and a displacement of the plates R1 and R2 with respect to the floor F are corrected based on the data detected by the laser length measuring machine 71 and the single-lens camera 72. For example, distances at predetermined three points on the plate R2 are measured by the laser length measuring machine 71, and the single-lens camera 72 captures images of the upper and lower ends of the boundary between the plates R1 and R2. The inclination and displacement are corrected based on the data thus acquired.

After the correction is completed, as shown in Sections (a) and (b) of FIG. 4, the nozzle orifice 32*a* of the dispenser 3 is brought close to the plate R2, and the dispenser 3 is moved along the edge of the plate R1 to draw a wavy trajectory extending from the top toward the bottom in the figure. While the dispenser 3 is being moved, the sealing liquid is ejected from the nozzle orifice 32*a* toward the plate R2. Consequently, as shown in Section (b) of FIG. 4, the sealing liquid adheres along the wavy edge of the plate R1.

Next, the brush operation mechanism 5 is moved to the brush replacer 9, and a brush unit 4 having a brush bristle bundle 41*a* in a cup shape is attached to the operation mechanism 5.

The brush unit 4 is moved to the plate R2 having the sealing liquid adhering thereto, and the position and orientation of the brush unit 4 are adjusted such the rotational axis of the shaft 41*b* of the brush unit 4 becomes perpendicular to the plate R2. Then, the brush drive 51 is actuated to cause the brush unit 4 to spin around the shaft 41*b*.

Thereafter, as shown in Sections (c) and (d) of FIG. 4, while the bristle ends of the brush bristle bundle 41*a* of the brush unit 4 that is spinning are being pressed onto the plate R2 to flatten the sealing liquid adhering to the plate R2, the brush unit 4 is moved to draw a wavy trajectory extending from the top toward the bottom in the figure such that the bristle ends slide along the wavy edge of the plate R1. Thus, the brush bristle bundle 41*a* that is spinning and being pressed onto the plate R2 slide in a wavy manner, which results in that the sealing liquid is spread and smeared on the plate R2 along the edge of the plate R1, as shown in Section (d) of FIG. 4.

If the sealing liquid needs to be spread to have a width (the width extending laterally in FIG. 4) greater than the diameter of the brush bristle bundle 41*a*, the brush unit 4 is moved to the upper portion of the plate R2 again, and then, shifted to the left in FIG. 4 by a predetermined distance. The brush unit 4 is then moved to draw a wavy trajectory from the top toward the bottom in the figure.

As can be seen from the forgoing, the dispenser 3 of the application liquid feeder causes the sealing liquid to adhere to the rivet S1 as an application target surface, and thereafter, the brush unit 4 as the brushing means is moved to cause its brush bristle bundle 41*a* to slide on the rivet S1. Consequently, the sealing liquid that has been caused to adhere to the rivet S1 by the dispenser 3 may be spread and smeared on the entire rivet S1 by the brush unit 4.

Further, the process step in which the dispenser 3 causes the sealing liquid to adhere and the process step in which the brush unit 4 smears the sealing liquid are independent from each other. This may stabilize the amount of the sealing liquid applied to and spread on the rivet S1, which may provide an advantage in providing uniform quality.

The brush bristle bundle 41*a* is configured as a rotary brush capable of spinning around the axis extending in the longitudinal direction of the shaft 41*b*. Therefore, when sliding on the rivet S1, the brush bristle bundle 41*a* repeatedly comes into contact with the rivet S1 along with its spin. This provides an advantage that the sealing liquid may be smeared evenly and stably on the rivet S1.

Further, since the speed and direction of the spin of the brush bristle bundle 41*a* are variable, the movement of the brush bristle bundle 41*a* may be adjusted in accordance with the shape of a target surface and other factors. This provides an advantage in smearing of the sealing liquid.

Furthermore, by means of the brush replacer 9, the brush unit 4 may be replaced with another brush unit 4 having a different brush bristle bundle 41*a* in a different shape such as a bevel shape or a cup shape. This may enable the use of a brush unit 4 having a suitable brush bristle bundle 41*a*, in accordance with the shape of a target surface and other factors.

To apply and spread the sealing liquid to and on the rivet S1, the trajectory of the spin of the brush bristle bundle 41*a* around the axis extending along the longitudinal direction of the shaft 41*b* is combined with the trajectory of the revolution around the center axis of the rivet S1. This provides an advantage that the trajectories of the brush unit 4 on the rivet S1 may be adjusted easily.

Moreover, the dispenser 3 is inclined, which provides an advantage that the nozzle orifice 32*a* may be brought close to the area surrounding the base of rivet S1 without causing interference between the dispenser 3 and the structure S, and an advantage that the sealing liquid may stably reach the outer peripheral surface of the rivet S1 and the area of the wall Sp surrounding the base of the rivet S1.

<Other Embodiments>

In the foregoing, the wall Sp, the rivets S1-S5 projecting perpendicularly from the wall Sp, and the plates R1 and R2 overlapping with and coupled to each other are adopted as the targets where the application device D applies and spread the sealing liquid. However, these are merely examples.

Although the brush bristle bundle 41*a* is configured as a rotary brush capable of spinning around the shaft 41*b*, this configuration is not essential. The brush bristle bundle 41*a* may be configured such that its bristle ends reciprocate within a predetermined range, instead of being capable of spinning.

In the above description, the speed and direction of the spin of the brush bristle bundle 41*a* as a rotary brush are variable. This configuration is not essential.

Although the brush unit 4 is replaceable with another brush unit 4, this configuration is not essential. The specific manner to replace the brush unit 4 is not limited to the manner described above. For example, the brush unit 4 may be replaced manually.

In the above description, the application device D includes the articulated robot 1. However, the application device D does not have to include the articulated robot 1. The configuration for the articulated robot 1 is not limited to the one described above. For example, the casing 11 may be configured to move on a travelling rail, so that the sealing liquid may be applied to and spread on an application target surface which is outside the operating area of the arm 12. The arm 12 may have a different configuration from the six-axis system. The tool unit 2 may have a pitch movement mechanism to cause the dispenser 3 to reciprocate in the pitch direction. Further, the tool unit 2 may have a mechanism to cause the brush unit 4 to reciprocate in the pitch direction.

Moreover, the tool unit 2 may be provided with, for example, an air cylinder for causing the dispenser 3 to reciprocate in the longitudinal direction of the support arm 21.

In the above description, the application device D is configured to calculate the relationship between the ejection pressures and the ejection amounts based on the measurement results provided by the ejection amount meter 8, and to adjust the ejection pressure to achieve a desired ejection amount. However, this configuration is merely an example. That is to say, this configuration for adjusting the ejection pressure is not essential. The specific manner to adjust the ejection pressure is not limited to the manner described above.

INDUSTRIAL APPLICABILITY

As can be seen from the foregoing, the application device for applying and spreading a paste-like application liquid to and on a target surface is capable of smearing the application liquid that has been caused to adhere to the target surface. Thus, the application device is industrially applicable.

DESCRIPTION OF REFERENCE CHARACTERS

Sp Wall (Target Surface)
S1-S5 Rivet (Target Surface)
R2 Plate (Target Surface)
D Application Device
1 Robot (Articulated Robot)
12 Arm
3 Dispenser
32*a* Nozzle Orifice
4 Brush Unit
41*a* Brush Bristle Bundle
41*b* Shaft
5 Brush Operation Mechanism
6 Control Unit
8 Ejection Amount Meter (Ejection Amount Measurer)

The invention claimed is:

1. An application device for applying and spreading an application liquid to and on a predetermined application area of a target surface, the application device comprising:

an application liquid feeder having a dispenser configured to eject the application liquid from a nozzle orifice;

a brushing means having a brush bristle bundle and spreading the application liquid on the target surface; and a controller configured to control operations of the application liquid feeder and the brushing means, wherein the dispenser is configured to move in directions including a direction perpendicular to the target surface, while ejecting the application liquid to the target surface, the brush means is configured to move in the directions including the direction perpendicular to the target surface, while spreading the application liquid on the target surface, the controller is configured to perform successive steps of:

ejecting a predetermined amount of the application liquid from the nozzle orifice to the target surface, while moving the nozzle orifice within the application area of the target surface, thereby causing the application liquid to adhere to the target surface, and spreading the application liquid, which has adhered to the target surface, on the predetermined application area by causing the brush bristle bundle to slide on the target surface, without ejecting the application liquid from the nozzle orifice, wherein the controller is configured to start to perform the step of spreading the application liquid after completion of the step of ejecting the predetermined amount of the application liquid.

2. The application device of claim 1, wherein the brush bristle bundle of the brushing means is configured as a rotary brush attached to an end of a rotatable shaft.

3. The application device of claim 2, wherein the brushing means is configured such that a rotational speed and a rotational direction of the rotary brush are variable.

4. The application device of claim 1, wherein the brushing means comprises a plurality of brushing means which are of different types and have brush bristle bundles in different shapes.

5. The application device of claim 1, wherein the dispenser and the brushing means are mounted to a distal end of an arm of an articulated robot, the dispenser and brushing means being mounted in spaced apart relation to one another, such that the dispenser is configured to eject the application liquid to adhere to the target surface without the brushing means concurrently spreading the application liquid ejected from the dispenser and adhered to the target surface.

6. The application device of claim 1, wherein the application liquid is configured as a liquid which hardens with time, the application liquid feeder is configured to adjust an ejection amount of the application liquid to be ejected from the nozzle orifice by regulating an ejection pressure applied to the application liquid contained in the dispenser, the application device includes an ejection amount measurer configured to measure the ejection amount of the application liquid ejected from the nozzle orifice, and the application liquid feeder periodically measures an ejection amount of the application liquid actually ejected from the nozzle orifice, and corrects the ejection pressure in accordance with measurement results.

* * * * *